United States Patent [19]

Hahner et al.

[11] 3,964,888

[45] June 22, 1976

[54] VACUUM SWEEPER

[75] Inventors: Reinhard Hahner, Kemnat; Wilbert Reibetanz, Leinfelden; Karl Wanner, Echterdinge, all of Germany

[73] Assignee: Robert Bosch G.m.b.H., Stuttgart, Germany

[22] Filed: Sept. 25, 1974

[21] Appl. No.: 509,341

[30] Foreign Application Priority Data

Oct. 1, 1973 Germany ..... 2349338

[52] U.S. Cl. ..... 55/274; 55/276; 55/337; 55/472; 55/DIG. 3; 55/DIG. 21; 55/DIG. 34; 116/114 AD; 181/36 C; 181/62

[51] Int. Cl.[2] ..... B01D 50/00

[58] Field of Search ..... 55/274, 276, 337, 472, 55/DIG. 3, DIG. 21, DIG. 34; 116/114 AD; 181/33 K, 35 C, 36 C, 37, 62

[56] References Cited

UNITED STATES PATENTS

| | | | |
|---|---|---|---|
| 1,198,945 | 9/1916 | Moss | 55/DIG. 3 |
| 1,921,085 | 8/1933 | Korittke | 55/276 |
| 2,034,373 | 3/1936 | Bilde | 55/274 X |
| 2,198,568 | 4/1940 | Yonkers, Jr. | 55/276 X |
| 2,327,553 | 8/1943 | Donselle | 55/276 X |
| 2,516,707 | 7/1950 | Lewyt et al. | 55/276 X |
| 2,767,904 | 10/1956 | Doyle | 55/472 X |
| 3,024,655 | 3/1962 | Dwyer et al. | 55/274 X |
| 3,154,171 | 10/1964 | Knutson et al. | 181/33 K |
| 3,195,530 | 7/1965 | Heidner | 181/33 K |
| 3,614,860 | 10/1971 | Grellsson | 55/276 |
| 3,820,310 | 6/1974 | Davis et al. | 55/337 X |

FOREIGN PATENTS OR APPLICATIONS

| | | | |
|---|---|---|---|
| 615,359 | 6/1933 | Germany | 55/276 |
| 905,474 | 9/1962 | United Kingdom | 55/274 |

*Primary Examiner*—Frank W. Lutter
*Assistant Examiner*—David L. Lacey
*Attorney, Agent, or Firm*—Michael J. Striker

[57] ABSTRACT

A vacuum sweeper, particularly for collecting borings, has an upright cylindrical receptacle with a tangential inlet for admission of an air stream which carries borings and/or other solids and an open top which is overlapped by a platelike air filter disposed below a cover which is separably connected with the receptacle and has downwardly extending projections to prevent upward flexing of the filter. A side channel vacuum pump is installed in the cover and has an inlet which draws air from the receptacle via filter and a passage of the cover, and an outlet which communicates with a sound deadening annular channel provided in the cover and concentrically surrounding the rotor of the pump. The open end of the channel extends upwardly and contains a spherical float which rises therein to a level indicating the rate of air flow from the channel. Certain surfaces bounding the channel in the cover are lined with layers of closed-pore deformable foamed synthetic plastic material which contributes to the soundproofing action. The rotor of the pump rotates about a vertical axis and is driven by an electric, hydraulic or pneumatic motor.

25 Claims, 4 Drawing Figures

III
III

VACUUM SWEEPER

BACKGROUND OF THE INVENTION

The present invention relates to vacuum cleaners or vacuum sweepers in general, and more particularly to improvements in vacuum sweepers which are especially suited to collect borings produced by drilling tools in shops, factories or the like.

A drawback of presently known vacuum sweepers is that they produce excessive noise. Certain presently known attempts to reduce such noise include the provision of silencers or mufflers which are installed directly on the casing of the vacuum pump or blower or in a pipe through which the air stream issuing from the outlet of the pump escapes into the atmosphere. Such mufflers are rather complex, bulky and expensive, especially if their sound deadening effect is pronounced. Therefore, such mufflers failed to gain widespread acceptance in relatively small vacuum sweepers, for example, in portable vacuum sweepers for collection of borings or the like.

SUMMARY OF THE INVENTION

An object of the invention is to provide a novel and improved device for reducing the noise of vacuum sweepers, especially of relatively small portable vacuum sweepers for collection of borings or the like.

Another object of the invention is to provide a vacuum sweeper which embodies a novel and improved silencer system.

A further object of the invention is to provide a simple, compact, lightweight and inexpensive sound deadening arrangement for use in vacuum sweepers.

An additional object of the invention is to provide a sound deadening arrangement which can be incorporated into a component part of a portable vacuum sweeper for borings or the like.

Still another object of the invention is to provide a novel and improved vacuum sweeper which embodies the improved sound deadening arrangement.

A further object of the invention is to provide a vacuum sweeper wherein the sound deadening arrangement includes or cooperates with means for indicating the rate of air flow from the sweeper and hence the extent to which the solids-intercepting filter of the sweeper is clogged with borings or the like.

Another object of the invention is to provide novel and improved silencing elements for use in the sound deadening arrangement of a vacuum sweeper for borings or the like.

In pursuance of the above objects, and others which will become apparent hereafter, the present invention resides in a vacuum sweeper, particularly for collecting borings, which comprises a receptacle for the collection of solid particles. The receptacle has a first opening for admission of an air stream which contains the solid particles and an air-discharging second opening. A side-channel vacuum pump is provided, having an inlet in communication with the second opening to draw air from the receptacle and to thus induce the flow of the air stream into the receptacle by way of the first opening. In addition, the pump also has an outlet. A cover is provided for the second opening and has a passage which establishes a path for the flow of air from the receptacle into the inlet of the pump. The cover has a substantially annular channel which is in communication with the outlet of the pump to permit escape of air which is being drawn from the receptacle. Sound absorbing means is provided, including a substantially annular channel provided in the cover and communicating with the outlet. The channel has an open end which communicates with the atmosphere in order to permit the escape of air which is being supplied by the outlet of the pump.

This construction has the advantage that the sound absorbing means can in effect be integrated into and form a part of the cover, but can nevertheless be sufficiently large dimensioned to reduce the objectionable noise to an acceptable level. Moreover, the construction briefly outlined above makes it possible to discharge the air from the pump into the channel constituting part of the sound abosrbing means, without having to make the airflow undergo a substantial deflection, thus avoiding significant pressure losses that would otherwise occur.

A particularly effective sound absorbing function can be assured in the construction according to the invention if the substantially cylindrical internal surfaces flanking the channel are lined with sound absorbent material, or if at least one of these surfaces is so lined. Such sound absorbent material is advantageously but not necessarily a resiliently deformable material, for example a foamed plastic that may have closed pores.

It has also been found to be advantageous to arrange a float in the open end of the channel, so that the float can move in this open end under the influence of the air issuing from the channel. A cage may be provided over the open end and be formed with a cylindrical internal passage in which the float can move. The cage may be provided with windows through which the float becomes visible when it is lifted up in the open end of the channel as a result of the air flowing through the channel reaching or exceeding a certain rate of flow. All devices of the type here in question will eventually become clogged by the vacuumed particles, and therefore experience a decrease in the effectiveness of the suction exerted by them. As a general rule, this decrease comes about rather imperceptibly, and this brings with it the danger that an operator may not notice that the particles, such as borings, are no longer fully being removed from the bore hole. This, in turn, is highly disadvantageous because unless the particles are properly being removed from the bore hole, the drill head can become clamped or seized in the bore hole so that it can later be removed therefrom only with great difficulty, or in some instances not at all. The same is of course also true of any other instrument that performs such a drilling action. This difficulty is avoided according to the present invention because, as the device becomes increasingly clogged, the rate of air outflow from the channel through the open end and the cage will decrease, and the float will be lifted up less and less high until it finally descends below the level at which at can be seen through the aforementioned windows. Thus, the absence of any visual observation of the float in the windows provides a clear indication that the rate of air outflow has decreased below a certain level, which in turn is indicative of the fact that the device is being clogged, thereby alerting the operator to the necessity for taking corrective action.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3, 4:
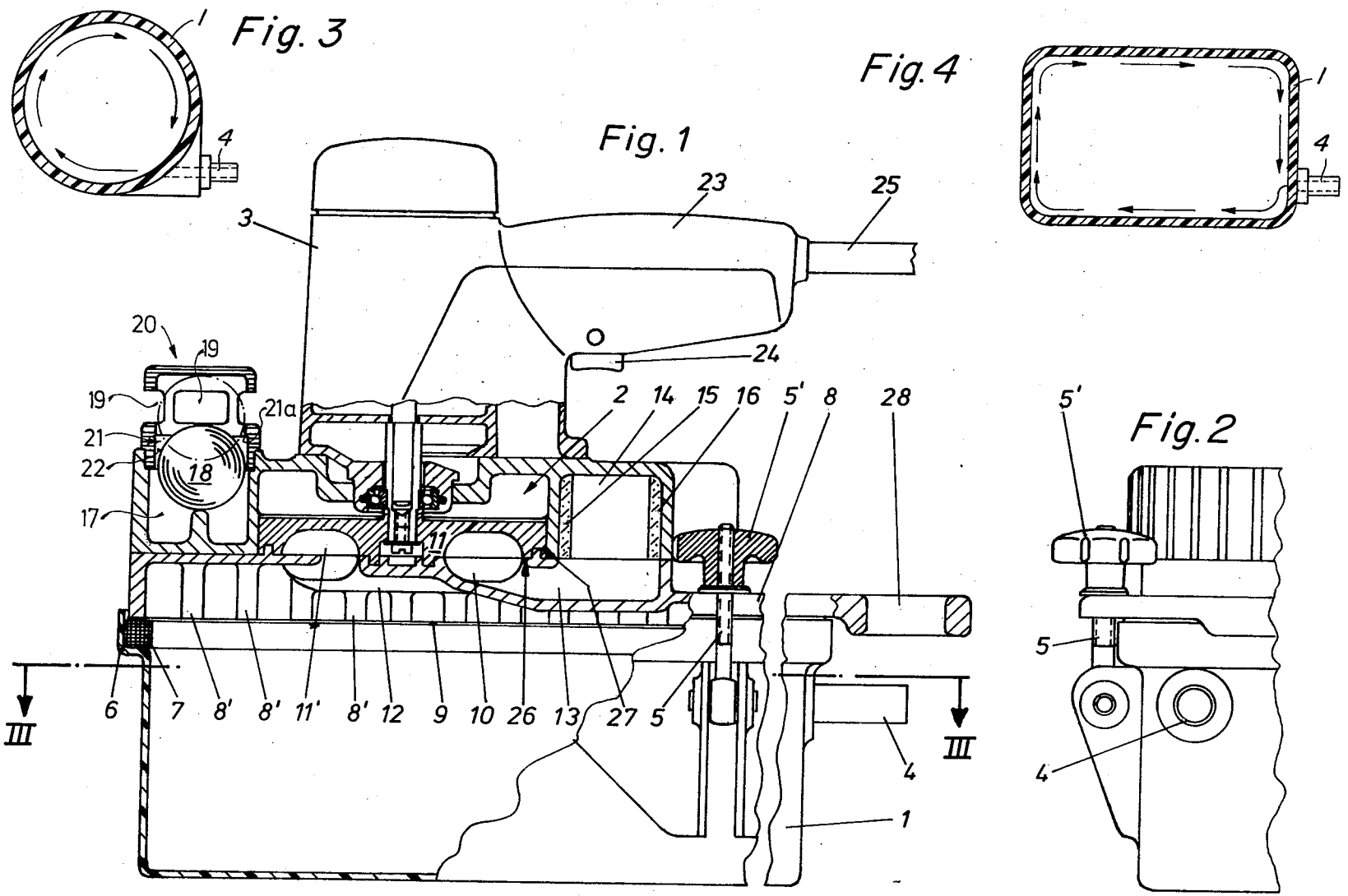
FIG. 1 is a side view, partly in vertical section, of a vacuum sweeper according to the present invention.
FIG. 2 is a fragmentary side view, showing a detail of the device in FIG. 1.
FIG. 3 is a diagrammatic cross-sectional view taken on line III—III of FIG. 1 on a smaller scale.
FIG. 4 is a diagrammatic cross-sectional view similar to FIG. 3 but showing a modified embodiment of the present invention.

A single embodiment of a vacuum sweeper according to the present invention has been illustrated by way of example in FIGS. 1 and 2. As the drawing shows, this vacuum sweeper has a receptacle 1 for the collection of solid particles, a side-channel pump 2 and a drive 3 which is only diagrammatically illustrated and which may be an electromotor, but could also be a hydraulic or a pneumatic motor.

The receptacle 1 has the form of an upright hollow cylinder as illustrated in FIG. 3, and is advantageously of synthetic plastic material, so that it can be inexpensively manufactured by injection molding. Its upper edge is formed with a Z-shaped flange 6 and its wall is formed in the region of this flange 6 with a nipple 4 to which a conduit, such as a hose or the like (not shown), can be connected through which a stream of air and particles entrained thereby, is to be aspirated into the receptacle 1. It is advantageous if the nipple 4 is laterally offset from the vertical line of symmetry of the receptacle 1, so that it discharges tangentially into the latter, thereby assuring that the incoming stream of air and the entrained particles therein will swirl in an essentially circular path in the receptacle 1, providing an action analogous to that of a cyclone to assure that the heavier particles become rapidly deposited on the walls of the receptacle 1.

A cover 8 is provided which closes the upper open end of the receptacle 1 and which is supported on the latter by means of a sealing ring 7 that is supported by the flange 6. The cover 8 is connected with the receptacle 1 on at least two opposite sides by respective screws 5 (one shown) each having a star-shaped nut 5′ threaded onto it. The screws 5 are connected with the receptacle 1 and the nuts 5 serve to draw the cover 8 down onto the sealing ring 7. A filter 9 is located intermediate the receptacle 1 and the cover 8, bridging the upper open end of the receptacle 1, the filter 9 being held in place by being clamped between the receptacle 1 and the cover 8. The screws 5 are pivoted, as most clearly shown in FIG. 2, to projecting ribs or otherwise configurated portions which are formed directly on the cover 1 during the injection molding thereof.

The filter 9 itself is in form of a plate of filter material, which plate has dimensions and a contour corresponding to those of the receptacle 1, or rather the upper open end thereof. The plate is secured to or placed onto the underside of the cover 8, which underside is formed with a plurality of downwardly projecting portions 8′ the free ends of which are located in a common plane and support the filter 9. Such a construction assures that even under conditions in which the filter is clogged and the pump 2 produces suction upon the filter tending to draw it upwardly in FIG. 1, no such upward drawing of the filter is possible, being prevented by the presence of the portions 8′.

The pump 2 itself is accommodated in the cover 8 and formed with a so-called side channel 10 which cooperates with a mirror-symmetrically configurated channel 11′ formed in a rotor 11. The air which has been drawn through the filter 9 out of the receptacle 1, and has thereby been freed of the particles that were retained in the filter 9, travels through a passage 12 into the side channel 10 wherein it becomes accelerated by the rotation of the rotor 11 which has the form of a flat disk whose underside which faces the side channel 10 is formed with the channel 11′. It should be understood, incidentally, that the channel 11′ need not be continuous but could also be formed as an annulus of individual recesses each of which has a cross-sectional configuration corresponding to that of the side channel 10, as is evident from a comparison of the cross-sectional configurations of the channels 10 and 11′ as shown in FIG. 1. Nevertheless, even if an annulus of individual recesses should be provided, it would still constitute a channel 11′. Irrespective of whether the channel 11′ is continuous or discontinuous in circumferential direction, the construction of FIGS. 1 and 2 makes it possible to significantly increase the transverse length of the sealing gap 26 between the rotor 11 and the cover 8 by so configurating the rotor 11 and the cover 8 that they form with one another a labyrinthine seal 27 which reduces pressure losses due to escape of the air through the sealing gap 26.

The side channel 10 also communicates with a channel 13 which terminates in a substantially annular channel 14 of the sound absorbing means. This channel 14 is of essentially rectangular cross-section and flanked by two upright cylindrical wall surfaces which in the illustrated embodiment are both lined with layers 15, 16 of sound-absorbing material. Advantageously, the sound-absorbing material is of a resiliently yieldable type, such as a resiliently yieldable synethetic plastic foam material having closed pores. The free cross-section remaining within the channel 14 after the layers 15, 16 are applied, is so large that no pressure losses will occur in the channel 14. Moreover, the air entering the channel 14 from the side channel 10 via the channel 13 need not undergo any very abrupt change in its direction of flow, which is a further feature in avoiding the occurrence of significant pressure losses.

The substantially annular channel 14, the outer diameter of which is at least approximately the same as the outer diameter of the receptacle 1, is provided with an open end 17 that communicates with the atmosphere so as to permit the escape to the atmosphere of air that has been supplied by the outlet of the pump 2. Located in the open end 17 is a float 18, here illustrated in form of a hollow celluloid sphere 18. The escape of the float 18 from the open end 17 is prevented by the presence of a cage 20 which has one or more windows 19 through which the interior of the cage can be observed from outside. The stream of outflowing air will raise the float 18 from the solid-line position in FIG. 1 to the chain-line position if the rate of flow per unit time is sufficient to do so. When this takes place, the float 18 can be visually observed through one or more of the windows 19 — the float may have an appropriately contrasting color for this purpose — and thus offers to the user a clear indication that the device operates as intended, that is that its suction effectiveness is not impaired. The cage 20 has a cylindrical inner passage 21 in which the float 18 can move and which is formed with a shoulder 21*a* so as to have an enlarged passage portion forming a bypass channel 22 which permits the escape of air past the float 18 even if the latter is in the full-line position, which it assumes when the rate of air flow is insufficient to raise the float 18 to or near the chain-line position. In the illustrated embodiment the float 18 will assume the full-line position when the rate of air flow drops below approximately 50 liters per minute. When the float 18 disappears from view through the windows 19, this is an indication to the user that the suction effectiveness of the device is impaired and that the necessary steps must be taken, i.e., that the filter must be cleaned or replaced, or the receptacle 1 be emptied.

Concentrically mounted on the cover 8 is the drive for the pump 2, which in this particular embodiment is an electromotor 3 that is coupled with and drives the rotor 11 of the pump 2. As mentioned before, however, a hydraulic or pneumatic motor could replace the electromotor 3. In any case, the electromotor 3 has a housing a portion of which is configurated as a hand grip 23 into which an electrical conductor 25 extends that supplies electrical energy to the electromotor 3. The hand grip 23 is further provided with a switch 24 for energizing and deenergizing the electromotor 3. A further hand grip 28 (shown fragmentarily) is provided or formed on the cover 8, so that the device can be held with two hands.

The operation of the novel vacuum sweeper will be self-evident. When the electromotor 3 or the analogous fluid motor is in operation, the rotor 11 will turn and the side channel pump 2 will therefore draw air from the receptacle 1 through the filter 9. The withdrawal of air from the receptacle 1 induces an air flow through the nipple 4, and this incoming flow of air of course contains the entrained solid particles, such as borings, which are to be accumulated in the receptacle 1. Because of the tangential entry of this air stream into the receptacle 1 via the nipple 4, the circulating movement of the air stream causes an action analogous to that of a cyclone, assuring that heavy particles are rapidly deposited on the walls of the receptacle 1. The fine particles in turn are captured in and retained by the filter 9. As a general rule, the fine particles will form a layer on the filter 9 and, when this layer exceeds a certain thickness, it will be detached from the filter 9 by the circulating air stream in the receptacle 1 and fall into the latter. The air drawn through the filter 9 by the side channel pump 2 travels into the channel 14 which causes next to no pressure losses, and then is discharged from the open end 17 of the channel 14 to the ambient atmosphere. Because the layers 15, 16 are of soft closed-pore synthetic plastic foam material, the high-frequency noise produced in operation of the sweeper is effectively dampened.

As soon as the rate of air flow through the open end 17 has reached a requisite level, the float 18 will be moved upwardly to the chain line position so that it can be observed through the windows 19. If for any reason whatsoever, that is for instance because of clogging of the filter 9 or because of excessive filling of the receptacle 1 with particles, the suction effectiveness of the sweeper decreases with a concomitant decrease in the rate of air flow through the open end 17 below the minimum requisite level, the float 18 will descend to the solid-line position, thus no longer being visible in the windows 19 and providing a clear signal to the user that the suction effectiveness of the sweeper is impaired and that corrective steps must be taken. On the other hand, such air as still issues from the open end 17 can continue to be vented to the ambient atmosphere due to the bypass channel 22 even though the float 18 is in the its solid-line position.

It should be understood that the bypass channel 22, whose presence and dimensioning make it possible to maintain the rate of air flow sufficient to raise the float 18 to its chain-line position within a restricted range, can also be provided if the internal passage in the cage 20 is not cylindrical but instead is conical or frustoconical. In certain circumstances it may even be possible for the cylindrical passage 21 to be of constant diameter, that is to eliminate the stepping which results from the provision of the shoulder 21*a*. Finally, it should be understood that other modifications may also be made with respect to the illustrated embodiment, so that for example the receptacle 1 may be quadratic or rectangular in outline, rather than cylindrical. This possibility is illustrated in FIG. 4. Evidently, the cover 8 could be connected with the receptacle 1 in a manner different from that illustrated.

It will be understood that each of the elements described above, or two or more together, may also find a useful application in other types of constructions differing from the types described above.

While the invention has been illustrated and described as embodied in a vacuum sweeper, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A vacuum cleaner, particularly for collecting borings, comprising a receptacle having a first opening for admission of a gaseous medium containing solid particles, a collecting chamber, and a discharging second opening; means for closing said second opening, including a cover connected to said receptacle and having a passage communicating with said collecting chamber; a side channel vacuum pump having an inlet and an outlet, said passage communicating with said inlet, said pump being operative for inducing flow of the gaseous medium from said collecting chamber through said passage into said inlet and for discharging the same into said outlet; and silencing means including an annular elongated channel in said cover and enclosed except for one open end communicating with said outlet and another open end longitudinally spaced from said open end and communicating with the ambient atmosphere.

2. A vacuum cleaner as defined in claim 1, wherein said second opening is the open top of said receptacle and said pump comprises a rotor rotatable about a vertical axis.

3. A vacuum cleaner as defined in claim 1, wherein said receptacle is an upright cylinder having a bottom wall and an open top constituting said second opening, said channel surrounding said pump and having an outer diameter which approximates the diameter of said receptacle.

4. A vacuum cleaner as defined in claim 3, wherein said pump is installed in said cover and has a rotor rotatable about a vertical axis, the center of said channel being located on said axis.

5. A vacuum cleaner as defined in claim 1, wherein said cover has two substantially cylindrical internal surfaces flanking said channel, and said silencing means further comprising sound absorbent material lining at least one of said surfaces.

6. A vacuum cleaner as defined in claim 5, wherein said material is deformable.

7. A vacuum cleaner as defined in claim 5, wherein said material is a foamed plastic.

8. A vacuum cleaner as defined in claim 7, wherein said foamed plastic has closed pores.

9. A vacuum cleaner as defined in claim 1, wherein said other open end of said channel extends upwardly; and further comprising a float installed in and movable in said other open end by the air issuing from said channel whereby the level of said float is indicative of the rate of air outflow from said channel.

10. A vacuum cleaner as defined in claim 9, wherein said other open end is a vertical port in said cover; and further comprising a cage overlying said other open end and having at least one lateral window for escape of air, said float being observable in said window at least when the rate of air flow exceeds a predetermined value.

11. A vacuum cleaner as defined in claim 10, wherein said float is a lightweight sphere.

12. A vacuum cleaner as defined in claim 11, wherein said float consists of celluloid.

13. A vacuum cleaner as defined in claim 10, wherein the cross-sectional area of said port exceeds the cross-sectional area of said float so that said float permits air to flow from said channel into said window when said float is located at a level below said window.

14. A vacuum cleaner as defined in claim 13, wherein said cage has a by-pass channel in communication with said port and said cage receives said float when the latter rises to the level of said window.

15. A vacuum cleaner as defined in claim 14, wherein said by-pass channel is conical.

16. A vacuum cleaner as defined in claim 14, wherein said cage has an annular shoulder between said port and by-pass channel bore and the diameter of said bore is less than the diameter of said port.

17. A vacuum cleaner as defined in claim 1, wherein said receptacle is a cylinder and said first opening is positioned tangentially with respect to the inner wall of said receptacle so that the stream of air entering said receptacle is set in circulatory motion.

18. A vacuum cleaner as defined in claim 1, further comprising an air-permeable filter overlying said second opening of said receptacle to intercept solid particles in air which is being drawn into said inlet.

19. A vacuum cleaner as defined in claim 18, wherein said receptacle has an open top constituting said second opening.

20. A vacuum cleaner as defined in claim 19, wherein said cover overlies said filter and comprises a plurality of downwardly extending projections abutting against said filter.

21. A vacuum cleaner as defined in claim 1, wherein said pump comprises a flat disk-shaped rotor and a stator adjacent to one side of said rotor, said inlet constituting a first arcuate channel provided in said stator and having an open side facing said rotor, and said rotor having a second arcuate channel having an open side facing said first arcuate channel.

22. A vacuum cleaner as defined in claim 21, wherein said arcuate channels are mirror symmetrical to each other as seen with respect to a plane which is normal to the axis of said rotor and is disposed between said stator and said rotor.

23. A vacuum cleaner as defined in claim 21, wherein said pump is mounted in said cover and further comprising a labyrinth seal interposed between said cover and said rotor.

24. A vacuum cleaner as defined in claim 21, wherein said second arcuate channel is composed of an annulus of circumferentially adjacent but discrete recesses formed in said rotor.

25. A vacuum cleaner as defined in claim 1, wherein said receptacle is of a rectangular outline and has a vertical line of symmetry; and wherein said first opening is laterally offset from said vertical line of symmetry and tangentially arranged with respect to an inner surface of said receptacle so that the stream of air entering said receptacle through said first opening will swirl in an essentially circular path in said receptacle.

* * * * *